United States Patent [19]

Straitz, III

[11] 4,101,257

[45] Jul. 18, 1978

[54] PILOT GAS CONSERVATION SYSTEM FOR FLARE STACKS

[75] Inventor: John F. Straitz, III, Meadowbrook, Pa.

[73] Assignee: Combustion Unlimited Incorporated, Elkins Park, Pa.

[21] Appl. No.: 807,198

[22] Filed: Jun. 16, 1977

[51] Int. Cl.[2] ..... F23D 13/20

[52] U.S. Cl. ..... 431/15; 431/18; 431/46; 431/75; 431/202

[58] Field of Search ..... 431/15, 16, 18, 46, 431/59, 60, 61, 75, 202

[56] References Cited

U.S. PATENT DOCUMENTS

| | | | |
|---|---|---|---|
| 3,730,673 | 5/1973 | Straitz | 431/202 |
| 3,822,984 | 7/1974 | Straitz | 431/202 |
| 3,979,991 | 3/1974 | Straitz | 431/202 |
| 3,995,986 | 12/1976 | Straitz | 431/202 |

FOREIGN PATENT DOCUMENTS

| | | | |
|---|---|---|---|
| 503 | 2/1915 | Netherlands | 431/75 |

*Primary Examiner*—Carroll B. Dority, Jr.
*Attorney, Agent, or Firm*—Zachary T. Wobensmith, 2nd; Zachary T. Wobensmith, III

[57] ABSTRACT

A pilot gas conservation system for flare stacks is provided in which the activation and control of the pilot gas burners is determined by the wind conditions so that if no flare gas is flowing the pilot burners are shut down and with moderate and minor wind conditions the supply of pilot gas is maintained at a lower level than that required for higher wind velocities. A flow responsive switch is provided to determine the flow of waste combustible gas to the stack so that, if required, the effect of the wind speed determines the pilot gas flow.

10 Claims, 3 Drawing Figures

16
17
48
60
12
61
28
10
15
19
20
32
57
79
76
75
62
63
64
66
72
71
83
84
69
68
67
70
82
81
86
80
85
56
18
11
27
78
50
51
52
53
54
55

PILOT GAS CONSERVATION SYSTEM FOR FLARE STACKS

CROSS REFERENCE TO RELATED APPLICATIONS

This application relates to improvements in my prior application filed Feb. 17, 1977, Ser. No. 769,709 for Flare Gas Stack with Purge Control and my prior application filed May 11, 1977, Ser. No. 796,016 for Multi-Pilot Gas Conservation System for Flare Gas Burners.

BACKGROUND OF THE INVENTION

1. Field of the Invention

This invention relates to pilot gas conservation systems for flare stacks.

2. Description of the Prior Art

In my prior application for Letters Patent filed Feb. 17, 1977, Ser. No. 769,709, provisions are made for start up, steady state or transient purge gas control and for failure of the purge gas supply, and take into account variable wind speed at or near the top of the stack, and other conditions, with provisions for pilot burner gas supply and ignition.

In my prior application filed May 11, 1977, Ser. No. 796,016, provisions are made for varying the activation of pilot gas burners dependent upon wind direction and wind velocity.

No satisfactory provisions have heretofore been made by others looking to the conservation of pilot burner gas when conditions do not justify maintaining a high level of pilot burner flame.

In accordance with the present invention of supply of gas to the pilot burners is determined by the wind conditions and when ignition or reignition is required and with increase or decrease of pilot burner gas supply as determined by wind speed conditions. Provisions are also made for manual override of the control system.

It is a principal object of the present invention to provide a pilot burner gas conservation system for flare gas stacks and the like which will reduce unnecessary delivery of pilot gas to the pilot burners of a flare stack as measured by the wind speed at or near the top of the stack.

It is a further object of the invention to provide a pilot gas conservation system for flare stacks and the like in which the wind velocity at or near the discharge end of the stack is utilized for control purposes.

It is a further object of the invention to provide a pilot gas conservation system for flare stacks and the like in which the flow of gas to the stack is utilized for control purposes.

It is a further object of the invention to provide a pilot gas conservation system which is simple but effective in its action.

Other objects and advantageous features of the present invention will be apparent from the description and claims.

BRIEF DESCRIPTION OF THE DRAWINGS

The nature and characteristic features of the present invention will be more readily understood from the following description taken in connection with the accompanying drawings forming part hereof in which.

Figure 1A:
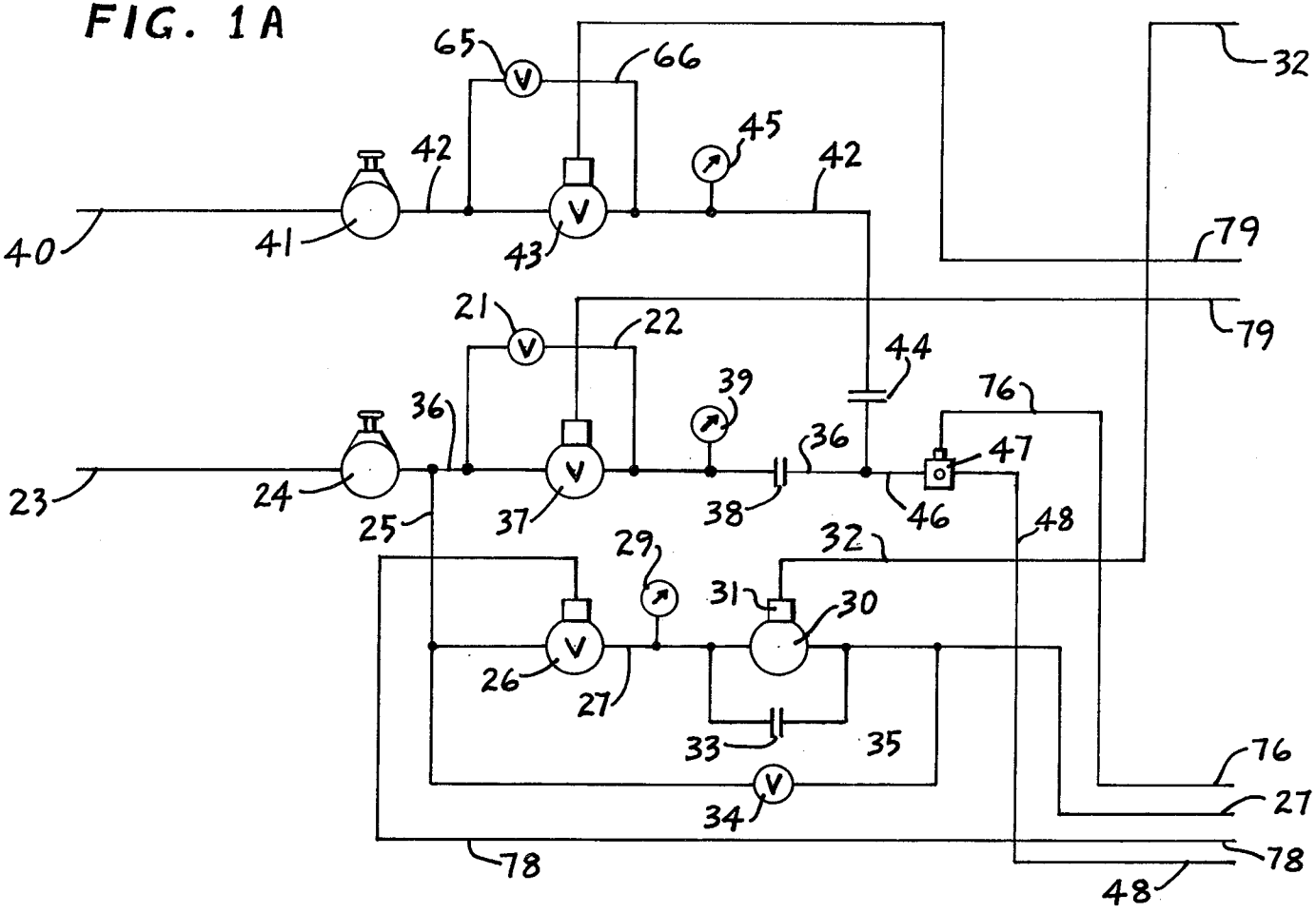
FIGS. 1A and 1B are a diagrammatic view of a flare gas stack with a pilot burner gas conservation system in accordance with the invention.

It should, of course, be understood that the description and drawings herein are illustrative merely and that various modifications and changes can be made in the structure disclosed without departing from the spirit of the invention.

DESCRIPTION OF THE PREFERRED EMBODIMENT

It is a common practice to utilize a flare stack for the disposal of waste combustible gas from chemical and industrial processes and particularly from oil refining. Such stacks may be vertical, horizontal or inclined. The waste combustible gas is not usually continuously available but is intermittently supplied as it becomes necessary to dump such gas. It is also necessary from time to time to dispose of combustible materials such as those stored underground, gas from pipe lines and gas from production platforms.

Referring now more particularly to the drawings a flare stack 10 is illustrated having a supply conduit 11 connected thereto for the supply of waste gas from a waste gas supply connection. The waste gas is combustible and may be derived from industrial operations and particularly from oil refineries.

The flare stack 10 may be of any desired type, may have a fluidic seal 12 spaced downwardly from the top to permit free upward movement of gas and provide a substantial obstacle to downflow in the stack. A suitable form of seal for this purpose is shown in my prior U.S. Pat. No. 3,730,673.

The flare stack 10 preferably has a burner 15 on the top or discharge end for aiding in the admixture with the waste gas of air for combustion, and with or without steam, and may have a hollow cylindrical slotted wind shield 16, closed at the bottom to protect the pilots 17 and the burner 15 from the wind. Suitable burners are shown in my prior U.S. Pat. Nos. 3,730,673; 3,797,991; 3,822,984; and 3,995,986 but the apparatus of the present invention is applicable to a wide range of burners. Purge gas may also be supplied to the supply conduit 11 and controlled in any desired manner.

The conduit 11 has a flow responsive switch 18 inserted therein which may be of any desired type but which is closed when there is gas flow through the conduit 11 and open if there is no flow.

The stack 10 preferably at the same elevation as its discharge end and subject to the same wind conditions has a wind responsive impeller 19, preferably an anemometer, which drives a signal source 20 for supplying a wind speed signal varying with the wind speed for utilization as hereinafter explained.

A source of combustible pilot gas under pressure is provided connected by a pipe 23 through a pressure regulator 24. A pipe 25, connected to the regulator 24, extends to an electrically actuated solenoid valve 26 which has a pipe 27 extending to and supplying gas to each pilot burner 17 through an air inducing venturi 28. A pressure gage 29 is provided connected to the pipe 27 for indicating the pressure of the pilot gas.

A valve 30 is provided in series in the pipe 27 controlled by a proportional controller 31, the controller 31 being connected by a conductor 32 from the signal source 20. A bypass orifice 33 is provided around the valve 30 to permit of minimum flow of pilot gas to the pilot burners 17. A manually operable bypass valve 34 is provided in a pipe 35 connected respectively upstream and downstream of the valves 26 and 30 for manual operation of the system, if desired.

The pipe 25 also has connected thereto a pipe 36 which has connected in series therein a solenoid controlled valve 37, and an orifice 38. A pressure gage 39 is provided connected to the pipe 36 for indicating the pressure of the gas. A manually operable bypass valve 21 is provided in a pipe 22 around the valve 37.

A source of compressed air is provided connected by a pipe 40 through a pressure regulator 41. A pipe 42, connected to the regulator 41 extends through a solenoid controlled valve 43 and an orifice 44 to the pipe 36 to provide a gas-air mixture for ignition. A pressure gage 45, connected to the pipe 42 indicates the pressure of the air at that location. A manually operable bypass valve 65 is provided in a pipe 66 around the valve 43.

A pipe 46 extends from the junction of the pipes 36 and 42 to a spark plug igniter 47 for delivery of an igniting flame through flame carrying pipes 48 to the pilot burners 17 to ignite the pilot gas at those locations.

A source 50 of electrical energy is provided which is connected by a conductor 51 to a manually operable switch 52 having one contact 53 for automatic operation of the system and another contact 54 for manual operation.

A conductor 55 extends from the automatic operation contact 53 of the switch 52 to the flow responsive switch 18 and a conductor 56 connected thereto has a conductor 57 which leads to the signal source 20 with a conductor 32 therefrom to the proportional controller 31 for the pilot gas valve 30 to vary the delivery of gas through the pipe 27 to the pilots 17 in accordance with the wind speed at the impeller 19.

Each of the pilot burners 17, two being shown in the drawing although more can be employed if desired, is provided with a thermocouple 60 which is connected respectively by conductors 61 to thermocouple temperature responsive control switches 62. Each control switch 62 has a signal light 63 connected thereto which is activated in the event that its pilot burner 17 is operating and a signal light 64 which is activated in the event of its pilot failure.

The flow switch 18 is connected by the conductor 56 to each of the control switches 62 for power input. The switches 62 are effective in the event of pilot failure, through conductor 67 to activate a timer motor 68 to rotate an interrupter wheel 69. A conductor 70 is connected from conductor 66 to a timer switch 71 operated intermittently by engagement of the timer wheel 69 engaging a tiltable timer arm 72.

The timer switch 71 controls the supply of current to a transformer 75 which is connected by a conductor 76 to the spark plug 47 for igniting the gas in the pipes 48 for flame delivery to the pilot burners 17. The conductor 56 is also connected by conductor 78 to the pilot valve 26. A conductor 79 connected to conductor 66 operates the solenoid valves 37 and 43 for the delivery of air and gas for mixing to provide the igniting flame. The conductor 66 is also connected by conductor 80 to a timer motor 81 which operates a timer wheel 82 which engages a spring returned arm 83 to activate an alarm timer switch 84 which activates a remote alarm to indicate pilot failure.

The manually operable switch 52 has a conductor 85 leading from its contact 54 through a switch 86 for manual activation of the spark plug 47 independent of the timer motor 68.

Figure 1B:
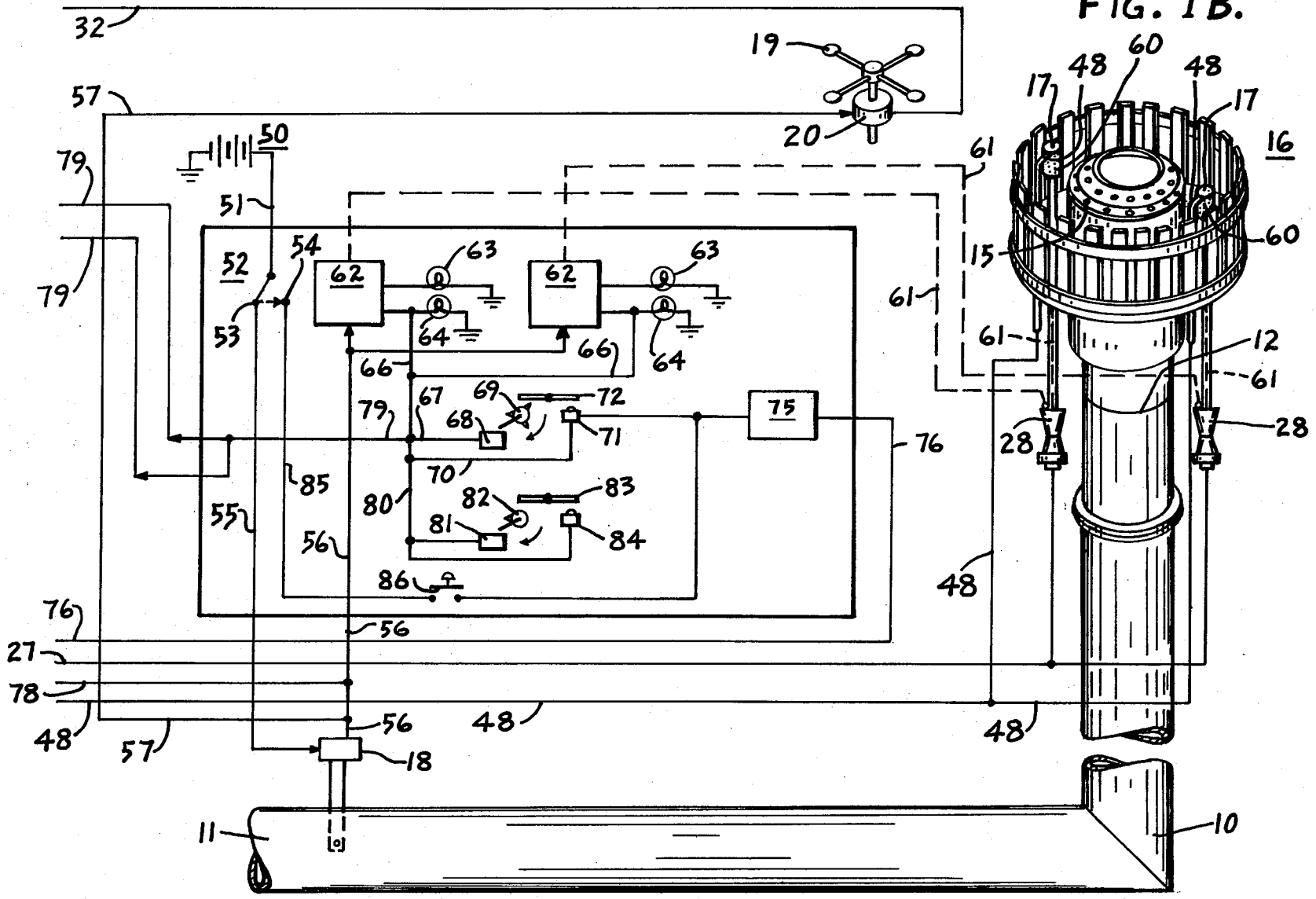
Figure 2:
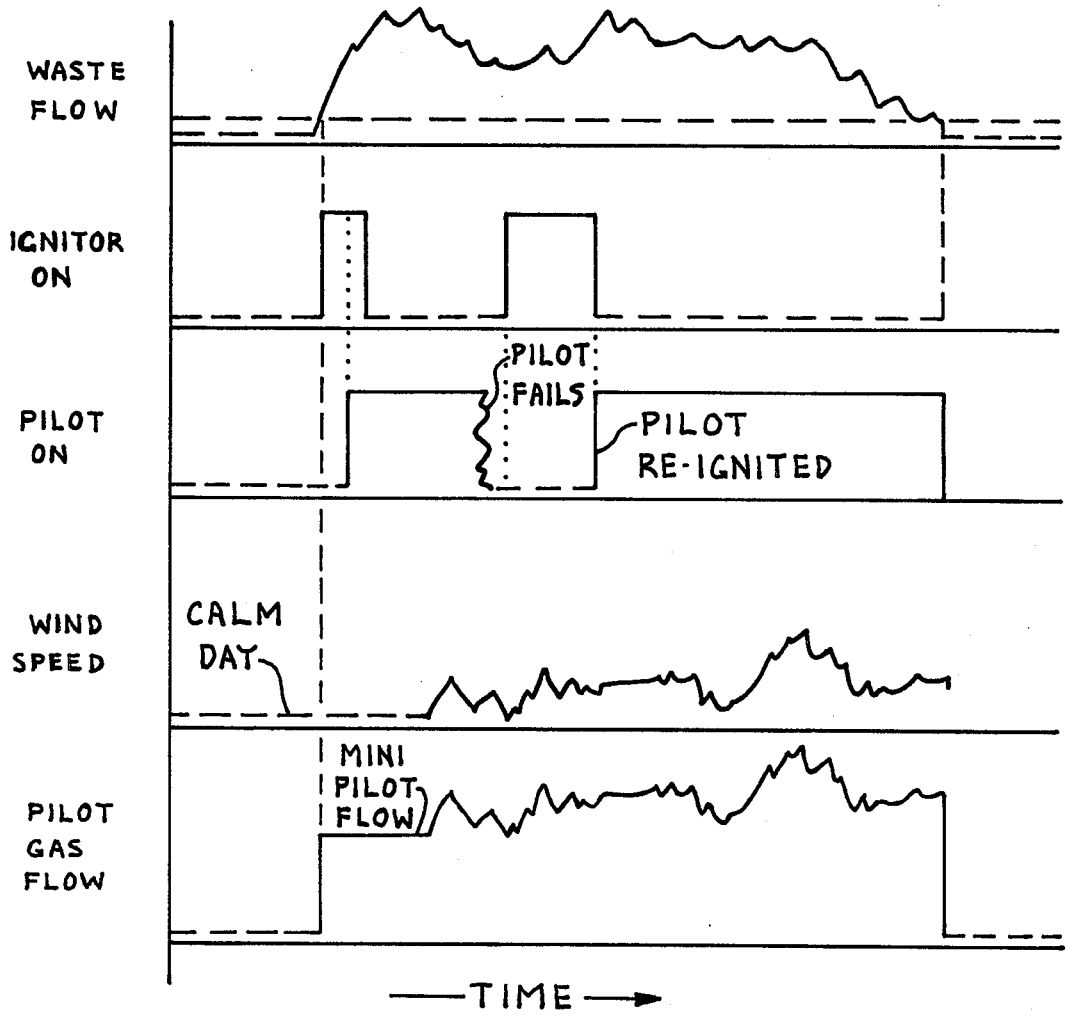
FIG. 2 is a diagrammatic view illustrating the operation of the pilot as determined by variations in wind speed.

The mode of operation will now be pointed out, reference being had to FIGS. 1 and 2.

In FIG. 2, the relationship is shown between waste gas flow, ignition turn on, pilot burner turn on, wind speed, and pilot gas flow, elapsed time being represented horizontally and relative values of the other factors being represented vertically.

Automatic activation of the pilot burners 17 or delivery of the igniting flame can be effected if the flow switch 18 is activated by gas flow in the conduit 11.

Assuming that air is supplied through pipe 40, under the control of the solenoid valve 43 through the pipe 42 to the pipe 46, and that combustible gas is supplied through pipe 23, under the control of the solenoid valve 37 to the pipe 36 for mixing with the air to provide a flammable mixture for ignition by the spark plug igniter 47 and delivery through the pipes 48 to the pilot burners 17, when the spark plug is activated from the transformer 75.

At the same time gas from the pipe 36 through pipe 25, controlled by the solenoid valve 26, is supplied through the bypass orifice 33 and the pipes 27 to the pilot burners 17.

In the event that there is no heat at either of the thermocouples 60 because the respective pilot burners 17 are not operating, the control switches 62 activate the igniter sequence and the alarm switch 84 if ignition does not occur after three attempts.

The wind responsive impeller 19, dependent on the wind velocity, through its signal source 20 acts on the proportional controller to position the valve 30 to regulate the flow of pilot gas to the pilot burners 17 dependent on the wind velocity with reduction of gas delivery when the wind velocity is low.

Manual override control is effective for pilot burner and igniter by the valves 21, 34 and 65, and, in the manual control position of the selector switch 52, the manual switch 86 may be activated for manual control of ignition.

In FIG. 2 the relation of windspeed to pilot gas flow is indicated with the gas flow following the wind velocity fluctuations, minimum flow being provided through the orifice 33 whenever there is waste gas flow.

The relation of the ignition and pilot operation is also illustrated and shows the small time lag for pilot burner activation. A pilot failure is shown together with the activation of the ignition to overcome the pilot failure. The time delay of pilot operation in its relation to waste gas flow is also shown.

The shut down upon termination of waste gas flow, of ignition, pilot operation and pilot gas flow is also shown at the right side of FIG. 2.

I claim:

1. A control system for the pilot gas for a waste combustible gas flare burner having a pilot burner which comprises;

a waste combustible gas flare burner, a connection to a supply of pilot gas, a pilot burner for said flare burner connected to said supply connection igniting means for said pilot burner, control means for controlling the supply of pilot gas to said pilot burner comprising a wind speed responsive member contiguous to the flare gas burner and a pilot gas control valve means, control means for said igniting means comprising a member responsive to operation of said pilot burner.

2. A control system as defined in claim 1 in which said control means for controlling the supply of pilot gas comprises a member responsive to flow of gas to said burner flare gas.

3. A control system as defined in claim 1 in which said valve means includes a valve member having a proportional controller in controlling relation thereto and responsive to a signal from said wind speed responsive member.

4. A control system as defined in claim 1 in which said member responsive to operation of said pilot burner is a thermally responsive member.

5. A control system as defined in claim 1 in which pilot burner operating indicating means is provided responsive to the signal from said member responsive to operation of said pilot burner.

6. A control system as defined in claim 5 in which said indicating means includes pilot burner on and pilot burner off indicators.

7. A control system as defined in claim 1 in which said igniting means is controlled by pilot burner failure.

8. A control system as defined in claim 1 in which alarm means is provided responsive to pilot burner failure.

9. A control system as defined in claim 1 in which manual control means is provided for selective delivery of pilot gas to said pilot burner.

10. A control system as defined in claim 1 in which manual control means is provided for activating said igniting means.

* * * * *

UNITED STATES PATENT OFFICE

CERTIFICATE OF CORRECTION

Patent No. 4,101,257 Dated July 18, 1978

Inventor(s) John F. Straitz, III

It is certified that error appears in the above-identified patent and that said Letters Patent are hereby corrected as shown below:

Column 5,

Line 4, after "said", "burner flare gas" should be

- flare gas burner. -

Signed and Sealed this

Nineteenth Day of December 1978

[SEAL]

Attest:

RUTH C. MASON
Attesting Officer

DONALD W. BANNER
Commissioner of Patents and Trademarks